US006551215B1

(12) United States Patent
Gordon

(10) Patent No.: US 6,551,215 B1
(45) Date of Patent: Apr. 22, 2003

(54) CLIMBING STRUCTURE

(76) Inventor: Donald W. Gordon, 994 New Hope St., Draper, UT (US) 84020

( * ) Notice: Subject to any disclaimer, the term of this patent is extended or adjusted under 35 U.S.C. 154(b) by 0 days.

(21) Appl. No.: 09/451,255

(22) Filed: Nov. 29, 1999

(51) Int. Cl.[7] ..... A63B 9/00; A63G 31/00
(52) U.S. Cl. ..... 482/35; 482/37; 472/134
(58) Field of Search ..... 482/35, 37, 23, 482/55–56; 428/15; 156/61; 264/230; 5/910, 913; 472/134, 116; 40/477, 439, 422, 412

(56) References Cited

U.S. PATENT DOCUMENTS

| | | | | | |
|---|---|---|---|---|---|
| 3,534,961 | A | * | 10/1970 | Tiley | |
| 3,970,301 | A | * | 7/1976 | Lehmann | 272/113 |
| 5,092,587 | A | | 3/1992 | Jarosch | 272/112 |
| 5,242,652 | A | | 9/1993 | Savigny | 264/510 |
| 5,254,058 | A | | 10/1993 | Savigny | 482/37 |
| 5,308,075 | A | * | 5/1994 | Theriault | 273/195 |
| 5,390,926 | A | * | 2/1995 | Hanson | |
| 5,405,304 | A | * | 4/1995 | Petersheim et al. | 482/35 |
| 5,546,707 | A | * | 8/1996 | Caruso | 52/213 |
| 5,549,195 | A | | 8/1996 | Aulagner et al. | 198/850 |
| 5,618,131 | A | * | 4/1997 | Weber | 404/32 |
| 6,193,633 | B1 | * | 2/2001 | Jonas et al. | 482/35 |
| 6,322,454 | B1 | * | 11/2001 | Gordon | 472/134 |

FOREIGN PATENT DOCUMENTS

| | | | | |
|---|---|---|---|---|
| DE | 25 08 011 | * | 9/1976 | 482/37 |
| FR | 2666017 | | 2/1992 | |
| FR | 2671016 | | 7/1992 | |

OTHER PUBLICATIONS

Ramsay Thomas, Buidling Your Own Indoor Climbing Wall, 1995, Chockstone Press, pp. 13 and 18–20.*

* cited by examiner

*Primary Examiner*—Denise M. Pothier
(74) *Attorney, Agent, or Firm*—Mallinckrodt & Mallinckrodt; Robert R. Mallinckrodt

(57) ABSTRACT

A climbing structure is formed by evacuating an airtight cover bag over a structure core that includes blocks forming various hand and foot holds that creates a relief resembling a rock outcropping or rock surface. The blocks are preferably made of a rigid but soft or flexible material so that the blocks will hold their shape when used as hand and foot holds, but are somewhat soft in the event a climber falls or slides down the climbing face. The structure can be made in the form of a traditional climbing wall or take various other forms and may, when used as a recreational play climbing structure, have a core made up of a plurality of core blocks in a random arrangement. The structure may be used on land or in water as a water play device.

22 Claims, 4 Drawing Sheets

CLIMBING STRUCTURE

BACKGROUND OF THE INVENTION

1. Field

The invention is in the field of artificial climbing structures or walls and recreational play devices.

2. State of the Art

Rock climbing walls where a climber can practice climbing techniques and feel like he or she is climbing an actual rock face have become very popular. These walls are generally rigid with hard surfaces made of metal, fiberglass, plastic, wood, or other hard materials. Climbing walls may be stationary, portable, or rotatable, and all have rigid and hard climbing grips of varying size and configuration built in as an integral part of the wall or removably attached to the wall. Falls are generally controlled by means of the climber being attached to a belay line or repel line, which is automatic or hand controlled. If the person slips, his fall is checked by means of the safety line, or other safety devices. A safety device may or may not be necessary on a rotating wall since the climber stays close to the ground.

SUMMARY OF THE INVENTION

According to the invention, a climbing structure, which can be used for climbing practice similar to a prior art climbing wall or similar structure or as a recreational play apparatus, has a core structure which can be made of rigid, hard material, such as wood or metal, but preferably includes rigid but flexible materials such as Ethafoam or certain formulas of Urethane foam. The core is covered by covering material that is drawn tightly about the core by evacuating the area between the core and covering causing the covering material to be sucked tightly about the core. This forms a climbing structure that can be used as a climbing wall or similar apparatus or as a play apparatus. The climbing structure may be supported in various orientations by various supporting means such as metal or wood frameworks or inflatable devices which can support the climbing structure in water. The core may include materials or framework to give shape to and support the climbing structure.

An embodiment of the climbing structure for use as a climbing wall includes a sheet of material or a framework to which a plurality of blocks which, form hand and foot holds are secured. A cover is drawn tightly against and around the core to form the wall which is then supported by a room or building wall or framework.

An embodiment of the climbing structure for recreational play includes a plurality of blocks forming the core with the cover forming a bag for the blocks. The blocks are randomly arranged in the cover and the cover is evacuated to form the climbing structure. Air can be let into the cover and the blocks randomly rearranged at any time when it is desired to reconfigure the climbing surface.

THE DRAWINGS

Figure 1:
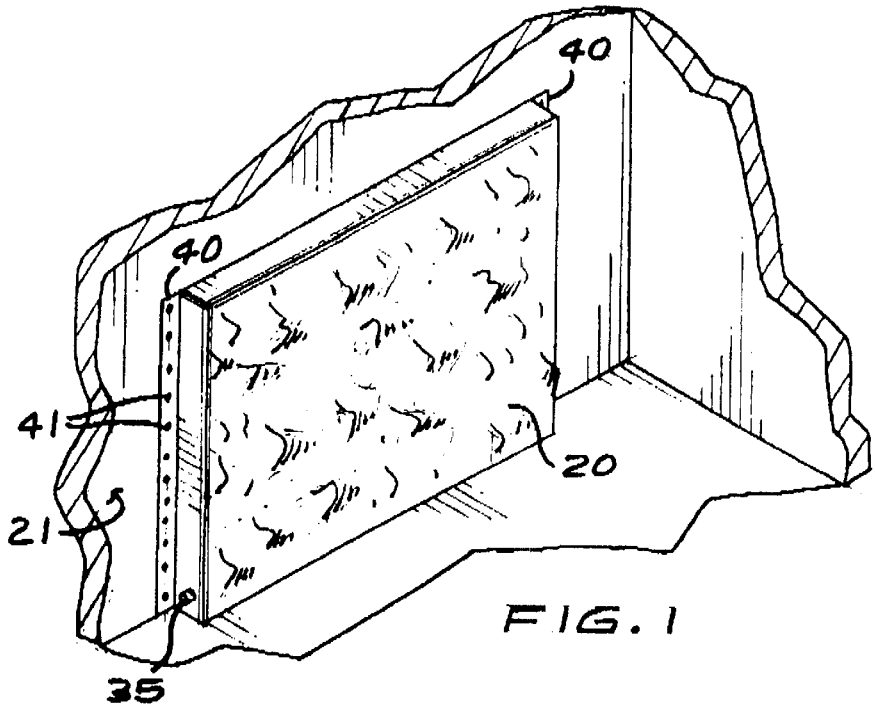
Figure 2:
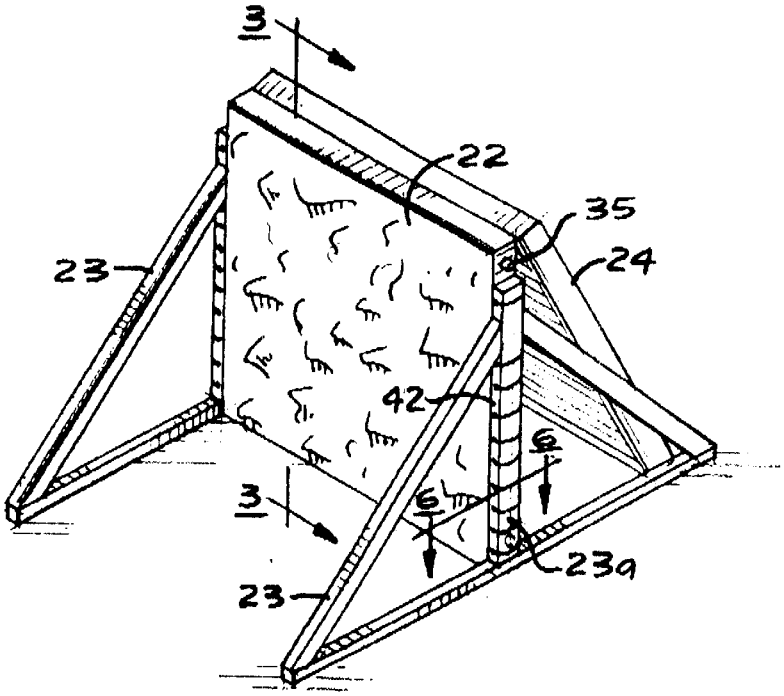
Figure 3:
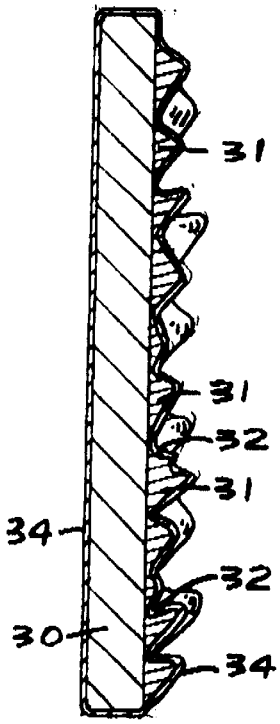
Figure 4:
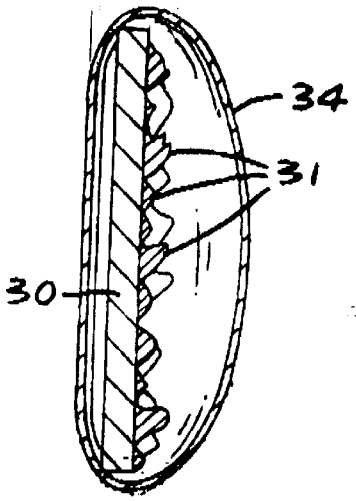
Figure 5:
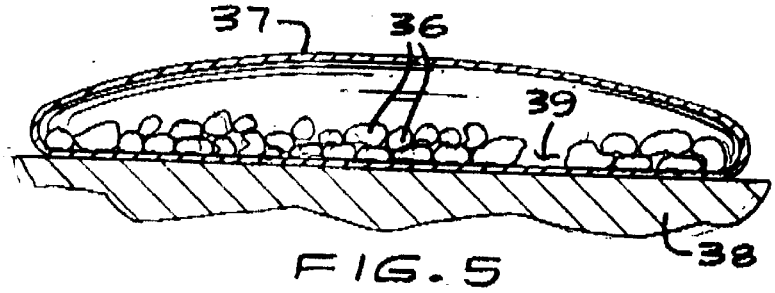
Figure 6:
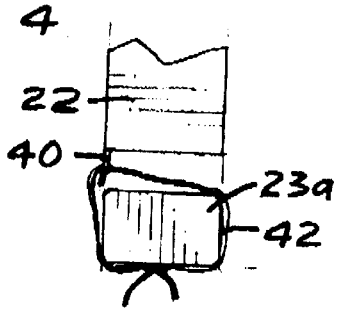
Figure 7:
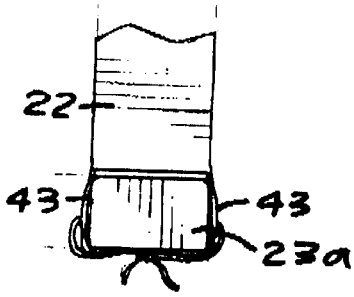
Figure 8:
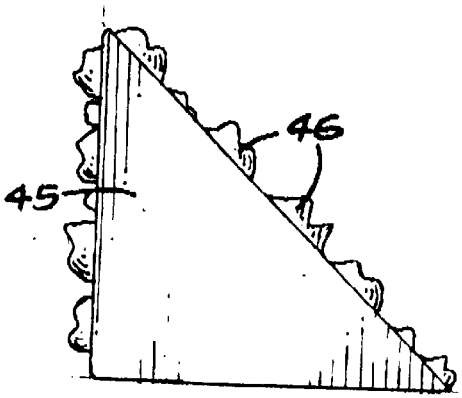
Figure 9:
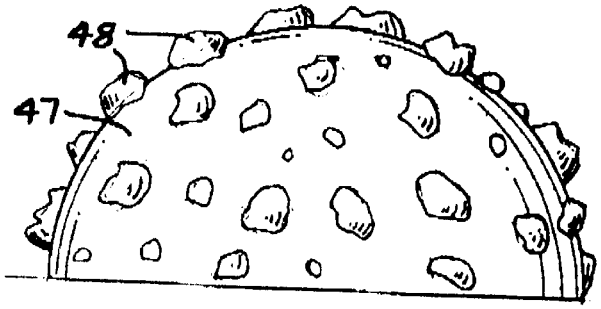
Figure 10:
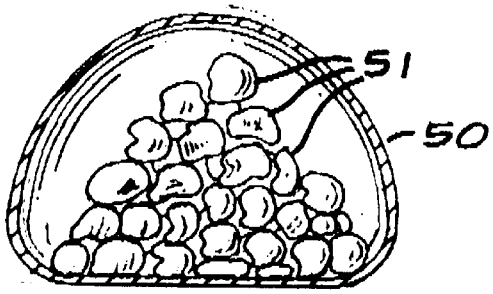
Figure 11:
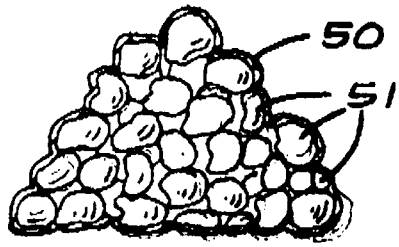
Figure 12:
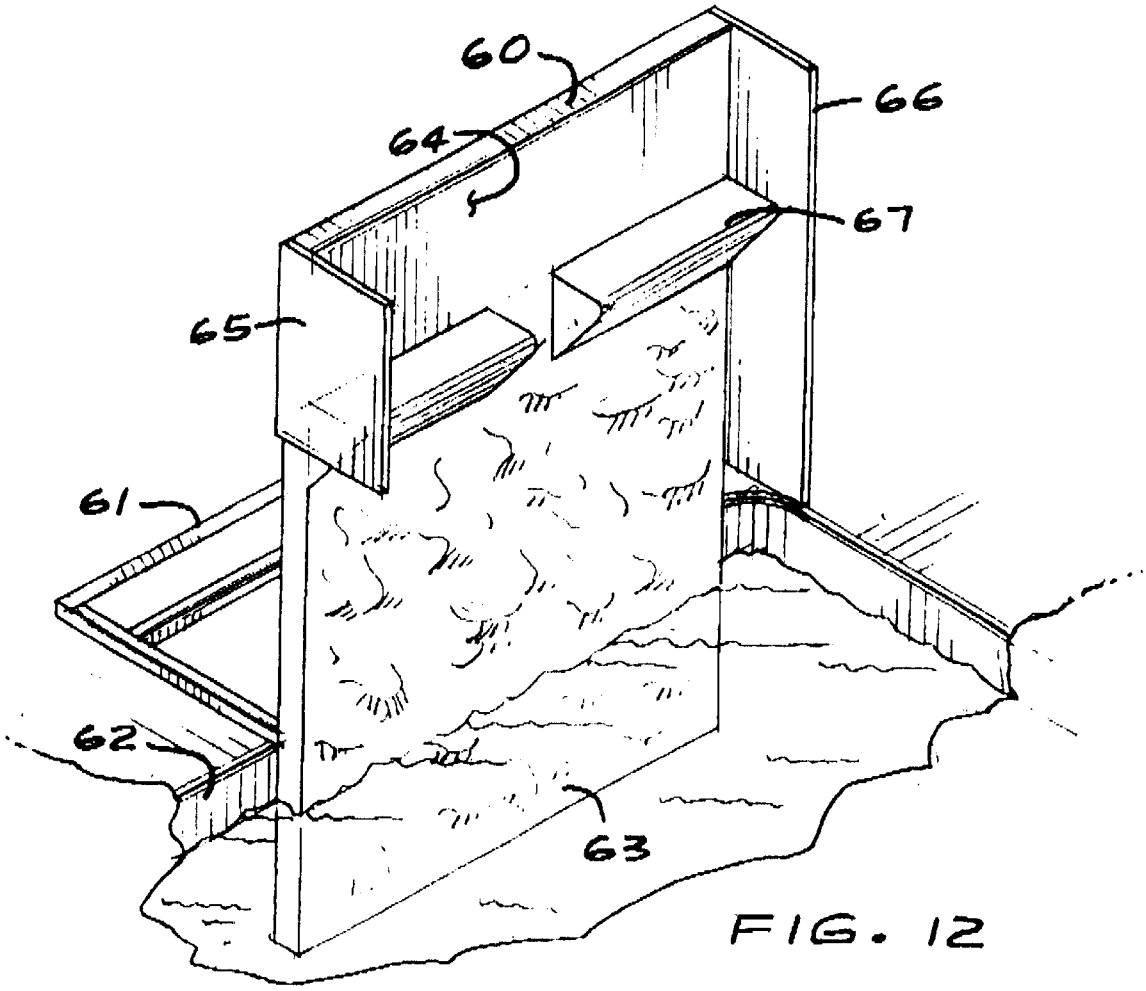
Figure 13:
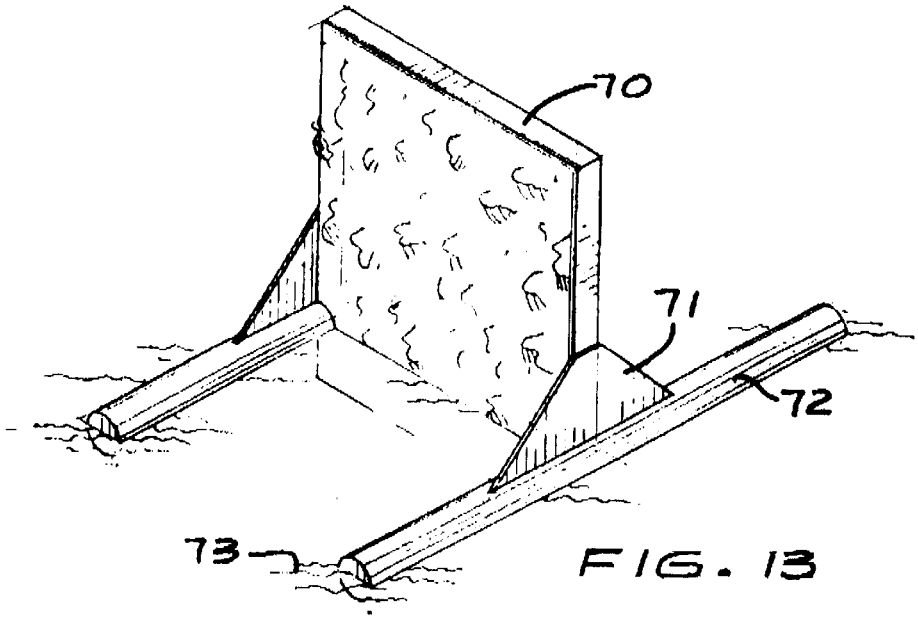
Figure 14:
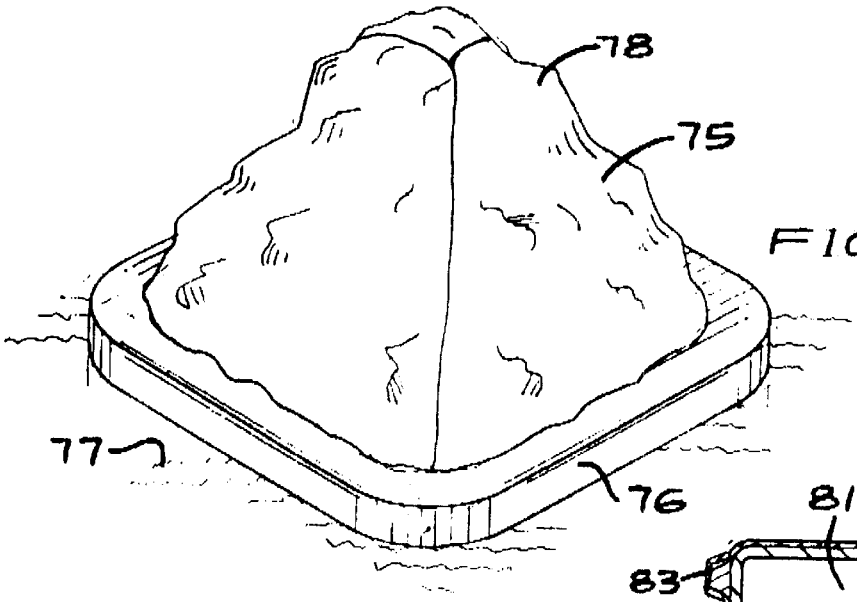
Figure 15:
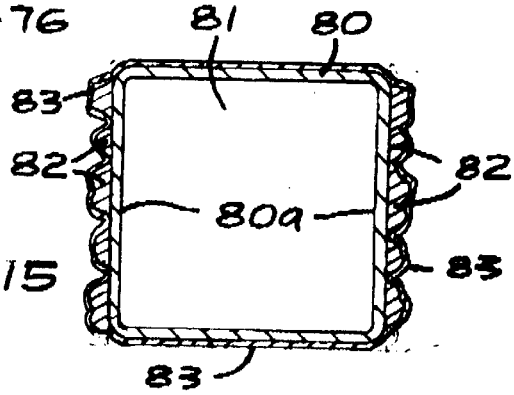

The best mode presently contemplated for carrying out the invention is illustrated in the accompanying drawings, in which:

FIG. 1 is a pictorial view of a climbing wall of the invention mounted to a room or building wall;

FIG. 2, a pictorial view of a climbing wall of the invention in a supporting framework;

FIG. 3, a vertical section through a climbing wail of the invention taken on the line 3—3 of FIG. 2;

FIG. 4, a vertical section similar to that of FIG. 3, but without the cover evacuated;

FIG. 5, a vertical section through an alternate embodiment of a climbing wall without the cover evacuated;

FIG. 6, a fragmentary horizontal section taken on the line 6—6 of FIG. 2;

FIG. 7, a fragmentary horizontal section similar to that of FIG. 6, but showing an alternate attachment embodiment;

FIG. 8, a side elevation of an alternate embodiment of climbing structure of the invention;

FIG. 9, a side elevation of a further alternate embodiment of the climbing structure of the invention;

FIG. 10, a vertical section through a further alternate embodiment of the climbing structure of the invention showing blocks inside the cover, not evacuated, in elevation;

FIG. 11, a vertical section similar to that of FIG. 10, but showing the cover evacuated;

FIG. 12, a pictorial view of a climbing structure of the invention mounted along a swimming pool edge;

FIG. 13, a pictorial view of a climbing structure of the invention mounted in a float device;

FIG. 14, a pictorial view of a further embodiment of the climbing structure of the invention and supporting structure; and FIG. 15, a vertical section through a further embodiment of the climbing structure of the invention.

DETAILED DESCRIPTION OF THE ILLUSTRATED EMBODIMENT

The climbing apparatus of the invention can take varying forms and can be used for various purposes. As a climbing wall for recreational rock climbing and rock climbing practice especially for children and beginners, the invention takes the form of a structure of sufficient size to provide the desired climbing experience supported on a wall or by a frame in the desired orientation such as a vertical orientation or a sloped orientation. For example, a climbing structure 20, FIG. 1, of the invention can be secured to a room or building wall 21 to be used as a traditional climbing wall or a climbing structure 22, FIG. 2, of the invention can be supported in a vertical orientation by frame 23 or a climbing structure 24 of the invention can be supported in a sloped orientation by frame 23. An arrangement as shown in FIG. 2, with both a vertical wall 22 and sloping wall 24 can be used. Climbing can then take place up one wall, such as the vertical wall of climbing structure 22 and down another wall such as the sloped wall of climbing structure 24. With vertical wall 22, climbing can be up one side of the wall and down the other. The walls can be of varying widths and heights with widths from three feet to twenty feet being satisfactory and heights from five feet to twenty feet being satisfactory depending upon the type of climbing done. Further, structures can be mounted side by side to form wider walls, if desired.

The climbing structures of FIGS. 1 and 2 can include a climbing structure core made up of a flat sheet 30, FIGS. 3 and 4, of substantially rigid material such as wood, metal, or foam, with shaped blocks 31 of substantially rigid but flexible material, such as a foam material (Ethafoam or certain Urethane foams has been found satisfactory), that, while substantially rigid, are also somewhat flexible and soft, arranged on sheet 30. The blocks 31 may be secured to sheet 30, such as by gluing, or merely arranged thereon without being secured. Hard materials such as wood can also be used for the blocks. Foam is preferred, particularly for beginners or for use in or around water. Further, rather than flat sheet 30, a suitable framework could be used to hold blocks 31, or, in many instances, merely the blocks can be used without the sheet 30 or any framework. The blocks 31 are preferably of at least several different shapes and provide the rock face appearance and relief to the structure. The blocks preferably are shaped and arranged to provide hand and foot holds, such as at 32, as climbing aids. The blocks may be of several predetermined shapes or may be formed to provide random shapes. Further, blocks can be provided on both sides of sheet 30 to form a climbing surface on both sides of the climbing structure.

The core is surrounded by a cover 34, FIGS. 3 and 4, that forms an airtight bag or bladder around the core. The cover has a valve 35, FIGS. 1 and 2, through which air can be drawn from the interior of the bag or bladder to evacuate it. FIG. 4 shows the core in the cover prior to evacuation of the cover. The cover can be made of various substantially air impervious or air holding materials such as those used for life rafts or emergency aircraft slides. Vinyl, Hypalon, or neoprene coated nylon or dacron of twenty-six ounce weight or greater, preferably thirty to thirty-five ounce weight, has been found satisfactory, although various other materials and weights can be used. Upon evacuation of the interior of the cover, the cover is drawn tightly against and around the core as shown in FIG. 3 to hold the various core pieces in place and to form a desirable external surface for climbing. It has been found that a wall and climbing structure formed in this manner has a very good climbing surface. When using a foam material for the blocks that has some softness, the wall provides some give for safety purposes.

The cover should be large enough so that when evacuated, it can surround and fill in around the blocks. Some folds in the cover material add to the surface features although excessive folds generally are not desirable. Not enough material means that the material may extend from high point to high point of the blocks without filling in around the blocks to provide the desired hand and foot holds.

The cover preferably is evacuated to form a partial vacuum in the cover and the valve closed to maintain the partial vacuum in the cover. However, the outlet can remain connected to the vacuum side of a blower or vacuum pump or to a vacuum tank to evacuate the air which provides a continuous partial vacuum in the cover. This compensates for any small air leaks that may occur in the cover material. Preferably the cover material is of a type that is tough enough to resist air leaks during use of the climbing structure.

A structure without sheet 30 or an alternate holding framework may be formed by placing blocks 36 in an elongate cover 37 on a substantially flat surface 38, such as a floor or the ground. The cover is then evacuated to form the wall structure. In such structure, it can be noted that the blocks 36 will tend to lie somewhat flat against the portion of the cover lying on the surface with more relief provided along the top of the blocks away from the surface. Evacuation of the cover substantially maintains this difference in relief and can provide a higher relief beginner side of the structure and a lower relief more advanced side of the structure. With the cover evacuated, the cover pulls tight about the blocks to form a substantially rigid structure that can be supported against a wall or in a frame as indicated in connection with FIGS. 1 and 2. Spaces between the blocks, as at 39, allow the cover material to come together and generally do not affect the effectiveness of the climbing structure.

Climbing structures such as 20 and 22 shown in FIGS. 3, 4, and 5 can be secured to a frame or wall as in FIGS. 1 and 2 in various ways. For example, the cover may have side fringes 40, FIG. 1, with eyelets 41 therein through which fasteners may extend to secure the climbing structure to the wall 21, or lacing 42, FIGS. 2 and 6, or other attachment means can extend through such eyelets and around a frame such as vertical member 23*a* of the frame 23 in FIG. 2. Alternatively flaps or fringes 43, FIG. 7, could extend from both edges of opposite sides of structure 22 and be laced together about vertical member 23*a* or otherwise secured to vertical member 23*a*.

The climbing structure can be provided in various configurations other than the wall configuration of FIGS. 1–4. For example, a triangular core structure 45, FIG. 5, can be formed in any suitable manner and blocks 46 placed on a vertical and sloped surface thereof and the triangular core structure covered and the cover evacuated. Similarly, a dome core structure 47 with blocks 48 could be used. Alternately, the climbing structure could be dome shaped to fit over a dome supporting structure.

The triangular and dome shapes, depending upon size and configuration, can be used as practice climbing structures or as recreational play structures for adults or children. An embodiment of the invention particularly suited for a recreational play structure is a cover 50, FIGS. 10 and 11, filled with loose blocks 51. The blocks are randomly and movably arranged in the cover when the cover is not evacuated, FIG. 10. With the cover evacuated, FIG. 11, the cover holds the blocks together securely and the structure then formed can be climbed upon. If desired, the cover can be opened to fill with air or air can be forced into the cover, so it again is as shown in FIG. 10, and the cover and blocks moved around to rearrange the blocks therein. Rolling, shaking, or other movement of the cover will cause movement of the blocks in the cover. The cover is then again evacuated to form the climbing structure with a new surface and arrangement. In this way, the structure can be rearranged when desired with almost infinite variety. The evacuation of the cover holds the blocks firmly and substantially immovably together during climbing on the structure. The structure will usually be between about three feet and ten feet tall.

It has been found that the climbing structure of the invention lends itself well to a water recreation device. The climbing structure 60, FIG. 12, can be supported by a framework 61 along a portion of a swimming pool edge 62 so that people in the pool can climb the structure and jump or drop off into the pool. Similarly, frame 61 can be mounted on a dock or other structure in or at the edge of a body of water to support the climbing structure. A person falling off the climbing surface of the structure merely falls into the water of the pool. It is preferred that the climbing structure extends down into the water between about twelve and eighteen inches as at 63 to give a climber foot grips to start climbing from the water. A flat (non-climbing) wall 64 is preferably provided at the top of the structure to prevent a person from falling over the back of the structure after climbing to the top of the climbing surface. Side walls 65 and 66 may also be provided, if desired, for safety purposes to prevent a person from falling off the edge of the climbing surface. Such wall may be just at the top of the climbing surface as wall 65, or may extend a distance down the side of the climbing surface as wall 66. A ledge 67 or larger blocks to form similar but discontinuous ledges at the top of the climbing surface may be provided so a person can stand and rest at the top of the climbing surface after climbing to the top and then jump off into the pool.

FIG. 13 shows a climbing wall structure 70 of the invention supported in a float device by a frame 71 mounted on floats 72. The float device can be placed in a body of water 73 such as a large swimming pool or lake. FIG. 14 shows a mountain structure 75 on a floating base 76 floating in a body of water 77 with a climbing structure 78 secured thereto. Again, with either of these configurations, a person falling or jumping off the structure falls into the water. A structure such as shown in FIG. 14, could have a base 76 filled with water or sand to stabilize the structure for use on land. For use on land, base 76 could be made larger with an inflatable cushion portion for safety to catch a user who may fall from the climbing structure.

FIG. 15 shows an inflatable supporting structure 80, such as a cylindrical structure which can be inflated by filling inside area 81 with air or other fluid. Blocks 82 are positioned on the outside walls of the inflatable supporting structure with cover 83 placed over the blocks 82 and outside walls 80*a*. The space between walls 80*a* and cover 83 is evacuated to form the climbing structure of the invention on the outside walls of supporting structure 80. In such case outside walls 80*a* in combination with cover 83 form the evacuated cover for the core formed of blocks 82. Such a structure can be used on land or in water. The climbing structure of the mountain structure of FIG. 14 could be similarly formed rather than having separate climbing structures attached to the mountain structure.

It should be realized that the drawings are somewhat schematic in their showing of the size, shape, number, and arrangement of the blocks and that various sizes, shapes, numbers, and arrangements of blocks can be used.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A climbing structure comprising:

climbing structure core which includes individual projecting blocks of material arranged to form surface relief features for the structure, at least each of a plurality of said individual projecting blocks being of a size and shape to project from the core a sufficient distance to individually provide hand and foot holds for use in climbing the structure;

covering material covering the climbing structure core to form an exterior climbing surface for the structure, said exterior climbing surface substantially maintaining the relief features of the climbing structure core; and a partial vacuum between the covering material and the climbing structure core so that the covering material is sucked closely against the climbing structure core.

2. A climbing structure according to claim 1, wherein the climbing structure core includes a plurality of loose projecting blocks.

3. A climbing structure according to claim 2, wherein the covering material forms an air tight bag, the projecting blocks are placed inside the covering material, and the covering material is evacuated to form the partial vacuum and suck the covering material closely against and about the projecting blocks to form a substantially rigid climbing structure.

4. A climbing structure according to claim 3, wherein the projecting blocks are randomly positioned inside the covering material.

5. A climbing structure according to claim 3, wherein the projecting blocks are randomly shaped.

6. A climbing structure according to claim 1, wherein the projecting blocks are secured to a core base which holds the blocks in a fixed position inside the covering material and the covering material is evacuated to form the partial vacuum and suck the covering material closely against and about the projecting blocks and core base to form a substantially rigid climbing structure.

7. A climbing structure according to claim 1, wherein the projecting blocks are formed of a substantially rigid but flexible material.

8. A climbing structure according to claim 7, wherein the projecting blocks are formed of a urethane foam.

9. A climbing structure according to claim 1, wherein the covering material forms a cover which is substantially air impermeable, wherein the cover is evacuated to form the partial vacuum, and wherein the cover is sealed after being evacuated.

10. A climbing structure according to claim 9, wherein the cover includes a valve which can be closed after the cover is evacuated to seal the cover.

11. A climbing structure according to claim 1, wherein the covering material forms a cover, and wherein the cover includes means to connect it to a source of vacuum and the source of vacuum maintains the partial vacuum.

12. A climbing structure according to claim 11, wherein the source of vacuum is a vacuum pump.

13. A climbing structure according to claim 11, wherein the means to connect the cover to a source of vacuum includes a valve that can be closed after the cover is evacuated.

14. A climbing structure according to claim 1, including means to secure the structure to a building wall.

15. A climbing structure according to claim 1, including means to secure the structure to a supporting frame.

16. A climbing structure according to claim 1, additionally including an inflatable supporting structure for holding the climbing structure in climbing position.

17. A climbing structure according to claim 1, including a supporting frame to support the structure in relation to a body of water so the climbing structure extends into the water to enable a person in the water to climb the structure.

18. A climbing structure according to claim 17, wherein the climbing structure includes a protective wall at the top of the structure.

19. A climbing structure according to claim 17, wherein the climbing structure has a top and includes means to allow a person to stand at the top of the structure.

20. A climbing structure according to claim 17, wherein the supporting frame is adapted to support the structure in relation to a swimming pool so the structure extends into the water of the swimming pool.

21. A climbing structure according to claim 1, including means to support the structure in a body of water so a person in the body of water can climb the structure from the body of water.

22. A climbing structure according to claim 1, wherein the climbing structure forms a substantially vertically oriented climbing surface.

* * * * *